US006204237B1

(12) United States Patent
Suzuki et al.

(10) Patent No.: US 6,204,237 B1
(45) Date of Patent: Mar. 20, 2001

(54) GLYCOL-BASED CLEANING SOLVENT

(75) Inventors: Masayasu Suzuki, Tsuchiura; Akiyasu Kaneko, Koshigaya, both of (JP)

(73) Assignee: Hitachi Techo Engineering Co., Ltd., Tokyo (JP)

( * ) Notice: Subject to any disclaimer, the term of this patent is extended or adjusted under 35 U.S.C. 154(b) by 0 days.

(21) Appl. No.: 09/399,204

(22) Filed: Sep. 17, 1999

(30) Foreign Application Priority Data

Sep. 18, 1998 (JP) ..... 10-265077
Sep. 10, 1999 (JP) ..... 11-257097

(51) Int. Cl.[7] ..... C11D 7/50; C11D 14/02; C11D 17/00

(52) U.S. Cl. ..... 510/412; 510/170; 510/174; 510/177; 510/273

(58) Field of Search ..... 510/170, 174, 510/177, 273, 412

(56) References Cited

U.S. PATENT DOCUMENTS 4,056,403 * 11/1977 Cramer et al. ..... 134/22 R
5,792,277 8/1998 Shubkin et al. .
6,148,634 * 11/2000 Sherwood ..... 62/434

FOREIGN PATENT DOCUMENTS 8-337795 12/1996 (JP) .
2576933 1/1997 (JP) .
2576941 1/1997 (JP) .
2576942 1/1997 (JP) .
9-255995 9/1997 (JP) .
10-46197 2/1998 (JP) .
2872664 3/1999 (JP) .
11-172291 6/1999 (JP) .

* cited by examiner

*Primary Examiner*—Yogendra Gupta
*Assistant Examiner*—John M Petruncio
(74) *Attorney, Agent, or Firm*—Arter & Hadden LLP

(57) ABSTRACT

A nonflammable glycol-based cleaning solvent which is not classified as, a hazardous material is provided. Isopropyl bromide (IPB) and/or n-propyl bromide (NPB), both of which being nonflammable solvents, is mixed to a main component comprised of propylene glycol-based solvents. The thus-obtained glycol-based cleaning solvent is given a nonflammable, flameproof characteristic. The first ingredient, comprised of one type of propylene glycol-based solvent or a plurality of types thereof, has a flash point of 28° C. or above. The amount of IPB and/or NPB being added to 100 pts.wt. of the first ingredient is in the range of 10–70 pts.wt., considering the negative influence of IPB and/or NPB on plastics and rubber.

8 Claims, 1 Drawing Sheet

GLYCOL-BASED CLEANING SOLVENT

BACKGROUND OF THE INVENTION

1. Field of the Invention

The present invention relates to a nonflammable glycol-based cleaning solvent which is used such as for removing flux from electronic parts, and for cleaning ink, adhesives and other such oils and fats.

2. Description of the Related Art

Glycol-based cleaning solvents are a new type of cleaning solvent which are known to be alternatives to the conventional cleaning solvents containing chlorine or fluorine. These glycol-based cleaning solvents consist mainly of low-toxic, highly-safe propylene glycol-based solvents, and are known to be eco-friendly and less harmful to the earth's ozone shield compared to chlorine/fluorine-containing cleaning solvents. Not only do the glycol-based cleaning solvents have a high KB (kauri-butanol) value and have a good cleansing ability, they scarcely affect plastics and rubber. Therefore, they are particularly used for removing flux from electronic parts, as well as for cleaning ink, adhesives and other oils and fats.

However, almost all propylene glycol-based solvents, which are the main ingredients of the glycol-based cleaning solvents, are flammable substances and classified as hazardous materials. Thus, not only is the management of these solvents strictly regulated under fire-protection law, the amount permitted for storage/equipment is also limited, making these cleaning solvents hard to handle. Therefore, considering that second- and third-class petroleum products (a classification according to Japanese fire-protection law; second-class petroleum products have a flash point ranging between 20° C.–70° C. (at 1 atm), and third-class petroleum products have a flash point ranging between 70° C–200° C. (at 1 atm)) are not so strictly regulated under law, the glycol-based solvents used for cleaning solvents were selected from these two groups. Nonetheless, the cleaning solvents containing glycol-based substances were still classified as hazardous materials, and thus, there existed inconveniences in safety and handling.

SUMMARY OF THE INVENTION

In order to solve the above and other problems, it is an object of the present invention to provide a nonflammable glycol-based cleaning solvent which will not be classified as a hazardous material.

A glycol-based cleaning solvent according to one aspect of the present invention comprises a first ingredient having a flash point of 28° C. or above and comprising one type of propylene glycol-based solvent or a plurality of types thereof, and a second ingredient comprising isopropyl bromide and/or n-propyl bromide, wherein the glycol-based cleaning solvent is given a nonflammable characteristic by mixing 10–70 parts by weight (pts.wt.) of said second ingredient to 100 pts.wt. of said first ingredient.

Isopropyl bromide (synonym: 2-bromopropane, referred to hereinafter as IPB) and n-propyl bromide (synonym: 1-bromopropane, referred to hereinafter as NPB) are known to be nonflammable, incombustible solvents, both of which being disclosed in Japanese Patent No. 2576933, No. 2576941 and No. 2576942. It is possible to turn the glycol-based cleaning solvent into a nonflammable, incombustible substance by mixing IPB and/or NPB to the glycol-based cleaning solvent.

The amount of IPB and/or NPB (10–70 pts.wt.) to be mixed to 100 pts.wt. of propylene glycol-solvent has been determined according to the following two reasons.

(1) IPB and NPB are halogenated hydrocarbon solvents having a characteristic of negatively affecting plastics and rubber. Thus, if an excessive amount of IPB and/or NPB is added, the glycol-based cleaning solvent will lose its advantageous, intrinsic characteristic, i.e., the characteristic of scarcely affecting plastics and rubber. In order not to cancel this beneficial characteristic, it is necessary to keep the amount of IPB and/or NPB below a predetermined level. The specific quantity (10–70 pts.wt.) has been determined according to the test results described later on.

(2) If the amount of IPB and/or NPB is too small, it would become difficult to realize the nonflammability of the cleaning solvent. That is, propylene glycol-based solvents having a high flash point will have to be used for the above-mentioned first ingredient, and this will reduce the dryability of the cleaning solvent and impair its cleaning ability.

Meanwhile, the first ingredient comprised of propylene glycol-based solvent(s) is to have a flash point of 28° C. or above, in order to obtain a nonflammable cleaning solvent which satisfies the conditions described in (1). This specific temperature (28° C.) has been determined according to the test results described later on.

Since the glycol-based cleaning solvent according to the present invention is given a nonflammable characteristic by adding IPB and/or NPB, both of which being nonflammable substances, to a main ingredient comprised of propylene glycol-based solvent(s), it will not be classified as a hazardous material, nor will it render specific restriction under law, such as fire-protection law. Thus, the amount permitted for storage/equipment will not be strictly limited, making these cleaning solvents safer and easier to handle. Further, since the amount of IPB and/or NPB being added to 100 pts.wt. of propylene glycol-based solvent(s) is in the range of 10–70 pts.wt., the cleaning solvent will hardly affect plastics and rubber.

As many different embodiments of this invention may be made without departing from the spirit and scope thereof, it is to be understood that the invention is not limited to the specific embodiments described hereinafter.

DETAILED DESCRIPTION OF PREFERRED EMBODIMENTS

Figure 1:
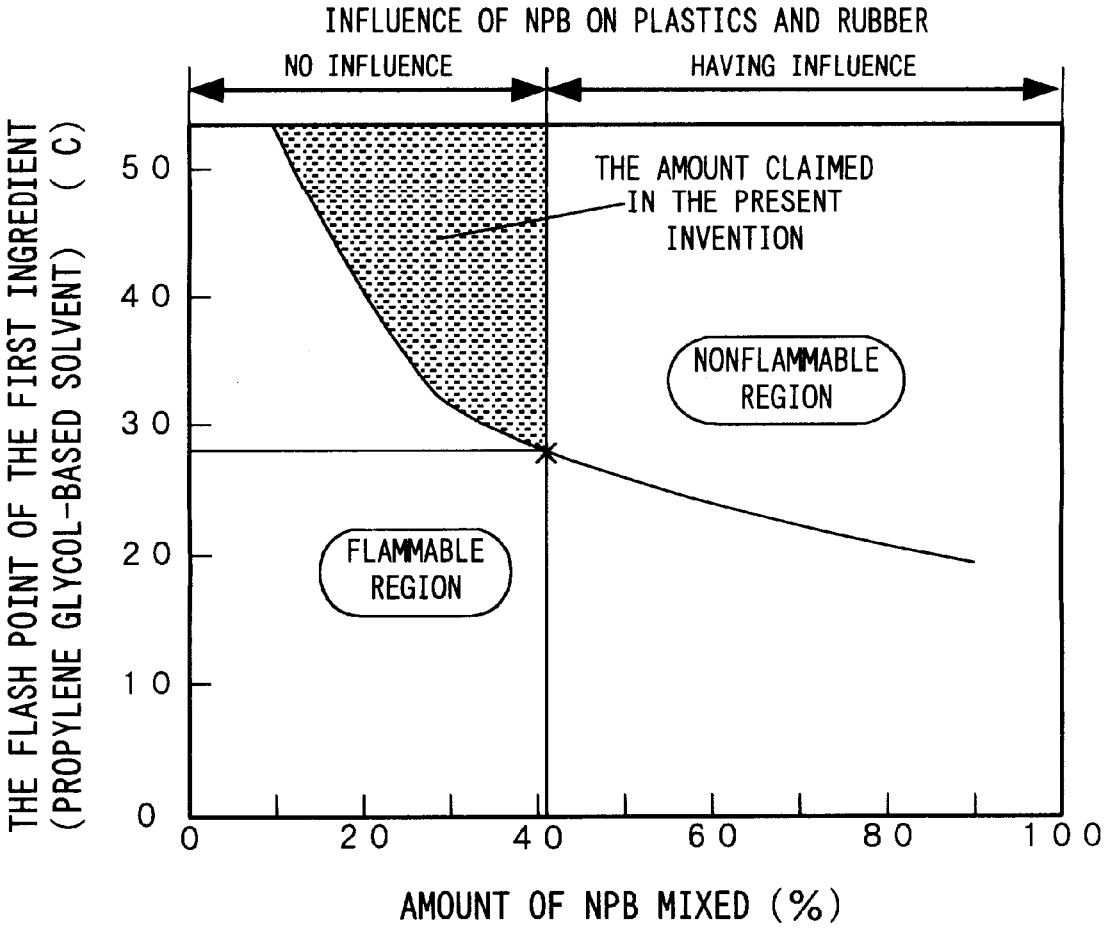
FIG. 1 is a graphical representation showing the relationship between the flash point of the first ingredient and the amount of NPB necessary to give the first ingredient a nonflammable characteristic.

A propylene glycol-based solvent used in the glycol-based cleaning solvent according to one aspect of the present invention is preferably selected from a group consisted of: propylene glycol methyl ether (boiling point (bp): 120° C., flash point (fp): 34° C., referred to hereinafter as PM); diprolylene glycol methyl ether (bp: 188° C., fp: 79° C., referred to as DPM); tripropylene glycol methyl ether (bp: 242° C., fp: 122° C., referred to as TPM); propylene glycol n-butyl ether (bp: 170° C., fp: 62° C., referred to as PnB); dipropylene glycol n-butyl ether (bp: 229° C., fp: 106° C., referred to as DPnB); tripropylene glycol n-butyl ether (bp: 274° C., fp: 138° C.); propylene glycol methyl ether acetate (bp: 146° C., fp: 46.5° C., referred to as PMA); propylene glycol diacetate (bp: 190° C., fp: 93° C., referred to as PGDA); propylene glycol phenyl ether (bp: 243° C., fp: 121° C., referred to as PPh); and propylene glycol monoethyl ether acetate (bp: 158° C., fp: 53° C.).

One propylene glycol-based solvent can be selected from the above-listed solvents as the first ingredient, or, a plurality of solvents can be mixed together to form the first ingredient. However, in the latter case, the type and amount of solvents to be mixed should be carefully considered so that the flash point of the mixed solvent does not fall below 28° C. That is, as long as the flash point of the resultant first ingredient is not below 28° C., a solvent having a flash point less than 28° C. and a solvent having a flash point over 28° C. can be mixed together to form the first ingredient.

As for the propylene bromides, either IPB or NPB can be individually selected for mixing, or, IPB and NPB can both be mixed. It is preferable to keep the amount of IPB and/or NPB to a small quantity, considering their negative influence on plastics and rubber. Further, since IPB and NPB are reactive to aluminum and its alloys, it is preferable to add at least one stabilizer to the cleaning solvent to prevent this reaction. Preferably, the stabilizers are to be selected from a group of nitroalkanes, ethers, epoxides, and amines. Also, since IPB and NPB emit an irritating odor, an appropriate amount of perfume substance, such as limonene, extract of shell ginger, isoamyl acetate, benzyl propionate, or ethyl butyrate, can be added to the cleaning solvent to cover this pungent odor.

When a propylene glycol-based solvent having a high flash point is selected, the dryability of the cleaning solvent tends to deteriorate. To compensate for this drawback, an appropriate amount of organic solvent having a boiling point ranging between 60° C.–150° C. can be added thereto as an agent for accelerating the dryability. The boiling point (60° C.–150° C.) of the organic solvent is lower than that of the propylene glycol-based solvent but higher than that of IPB and NPB. By adding such an organic solvent to the cleaning solvent, the amount of substance volatilizing at low temperature increases, thereby improving the dryability of the cleaning solvent. On the other hand, since the organic solvent will not volatilize before IPB or NPB at a low temperature, there will be no need to be concerned about the creation of a flammable atmosphere. An example of the organic solvents meeting the above-mentioned conditions are as listed: n-heptane (bp: 98.5° C., fp: −4° C.), methylcyclohexane (bp: 100° C., fp:−3° C.), ethylcyclohexane (bp: 129° C., fp: 19° C.), methanol (bp: 64.5° C., fp: 15.6° C.), ethanol (bp: 78.4° C., fp: 14° C.), isopropanol (bp: 82.4° C., fp: 12° C.), isobutanol (bp: 108° C., fp: 25° C.), ethyl acetate (bp: 77.1° C., fp:−5° C.), isopropyl acetate (bp: 84.5° C., fp: 4.4° C.), butyl acetate (bp: 126° C., fp:−5° C.), isobutyl acetate (bp: 117° C., fp: 17.8° C.), methyl ethyl ketone (bp: 79.6° C., fp:−7° C.), or methyl isobutyl ketone (bp: 115° C., fp: 27.2° C.). One type of organic solvent can be selected from the above solvents and be added to the cleaning solvent, or, two or more types of organic solvents can be mixed together and added.

Apart from the above-listed organic solvents, a slight amount of other organic solvents can be added to the cleaning solvent, insofar as the cleaning solvent maintains its nonflammable characteristic.

STUDY OF THE INFLUENCE ON PLASTICS AND RUBBER

A test was conducted to study the influence of NPB on plastics and rubber by increasingly mixing NPB to propylene glycol ethyl ether (PM), propylene glycol n-butyl ether (PnB) and dipropylene glycol n-butyl ether (DPnB), respectively. The test results are as shown in the Tables 1–3 below.

TABLE 1

| | TEST NO. | | | | | | | |
|---|---|---|---|---|---|---|---|---|
| | 1 | 2 | 3 | 4 | 5 | 6 | 7 | 8 |
| PM (pts. wt.) | 100 | 100 | 100 | 100 | 100 | 100 | 100 | 100 |
| NPB (pts. wt.) | — | 10 | 30 | 40 | 50 | 70 | 80 | 90 |
| flammability | yes | yes | yes | yes | no | no | no | no |
| nonrigid vinyl chloride | VG | VG | VG | VG | VG | G | S | S |
| polycarbonate | VG | VG | VG | VG | VG | G | S | S |
| silicon rubber | VG | VG | VG | VG | VG | VG | G | G |
| polyurethane rubber | VG | VG | VG | VG | VG | G | S | S |
| chloroprene rubber | VG | VG | VG | VG | VG | G | S | S |
| SBR | VG | VG | VG | VG | VG | G | S | S |
| natural rubber | VG | VG | VG | VG | VG | G | S | S |

VG: VERY GOOD G: GOOD S: SATISFACTORY
PM: propylene glycol methyl ether
NPB: n-propyl bromide

TABLE 2

| | TEST NO. | | | | | | | | | |
|---|---|---|---|---|---|---|---|---|---|---|
| | 1 | 2 | 3 | 4 | 5 | 6 | 7 | 8 | 9 | 10 |
| PnB (pts. wt.) | 100 | 100 | 100 | 100 | 100 | 100 | 100 | 100 | 100 | 100 |
| NPB (pts. wt.) | \| | 5 | 10 | 30 | 40 | 50 | 70 | 80 | 90 | 100 |
| Flammability | yes | yes | no | no | no | no | no | no | no | no |
| nonrigid vinyl chloride | VG | VG | VG | VG | VG | VG | G | S | S | S |
| polycarbonate | VG | VG | VG | VG | VG | VG | G | S | S | S |
| silicon rubber | VG | VG | VG | VG | VG | VG | VG | G | G | G |
| polyurethane rubber | VG | VG | VG | VG | VG | VG | G | S | S | S |
| chloroprene rubber | VG | VG | VG | VG | VG | VG | G | S | S | S |
| SBR | VG | VG | VG | VG | VG | VG | G | S | S | S |
| natural rubber | VG | VG | VG | VG | VG | VG | G | S | S | S |

VG: VERY GOOD G: GOOD S: SATISFACTORY
PnB: propylene glycol n-butyl ether
NPB: n-propyl bromide

TABLE 3

| | TEST NO. | | | | | | | | | | |
|---|---|---|---|---|---|---|---|---|---|---|---|
| | 1 | 2 | 3 | 4 | 5 | 6 | 7 | 8 | 9 | 10 | 11 |
| DPnB (pts. wt.) | 100 | 100 | 100 | 100 | 100 | 100 | 100 | 100 | 100 | 100 | 100 |
| NPB (pts. wt.) | | 5 | 8 | 10 | 30 | 40 | 50 | 70 | 80 | 90 | 100 |
| flammability | yes | yes | no | no | no | no | no | no | no | no | no |
| nonrigid vinyl chloride | VG | VG | VG | VG | VG | VG | VG | G | S | S | S |
| polycarbonate | VG | VG | VG | VG | VG | VG | VG | G | S | S | S |
| silicon rubber | VG | VG | VG | VG | VG | VG | VG | VG | G | G | G |
| polyurethane rubber | VG | VG | VG | VG | VG | VG | VG | G | S | S | S |
| chloroprene rubber | VG | VG | VG | VG | VG | VG | VG | G | S | S | S |
| SBR | VG | VG | VG | VG | VG | VG | VG | G | S | S | S |
| natural rubber | VG | VG | VG | VG | VG | VG | VG | G | S | S | S |

VG: VERY GOOD G: GOOD S: SATISFACTORY
DPnB: dipropylene glycol n-butyl ether
NPB: n-propyl bromide From TABLES 1–3, it can be appreciated that plastics and rubber are negatively affected when more than 70 pts.wt. of NPB is added to 100 pts.wt. of PM, PnB or DPnB, respectively. Considering these results, the amount of NPB being added to 100 pts.wt. of propylene glycol-based solvent should not be more than 70 pts.wt. Furthermore, it can be seen from the tables that when more than a specific amount of NPB is added to each of the propylene glycol-based solvents, the solvent turns nonflammable. The "specific amount" of NPB that must be added to 100 pts.wt of each of the propylene glycol-based solvents is: 50 pts.wt. for PM, 10 pts.wt. for PnB, and 8 pts.wt. for DPnB.

FLASH POINT OF THE FIRST INGREDIENT

It is preferable for the flash point of the first ingredient (the propylene glycol-based solvent mixture) to be high in order to obtain a nonflammable cleaning solvent using a small amount of NPB. However, if the flash point of the first ingredient is too high, the boiling point thereof will become accordingly high, and a rise in the boiling point will deteriorate the dryability of the cleaning solvent. Since this dryability is an essential characteristic of a cleaning solvent, it will be preferable to keep the flash point of the first ingredient as low as possible while maintaining the cleaning solvent nonflammable.

In this respect, a test was conducted to study the relationship between the flash point of the first ingredient and the amount of NPB necessary to turn the first ingredient nonflammable. A multitude of first ingredients, each of which having different flash points, was prepared by using either a propylene glycol-based solvent individually, or, by mixing a plurality of propylene glycol-based solvents. Then, NPB was gradually added to each of the first ingredients to determine the point (the amount) at which the first ingredient turned nonflammable. The flash point was determined by using a Tag closed-cuptester. The results of this test are shown in the graph of FIG. 1.

From FIG. 1, it can be appreciated that as the flash point of the first ingredient becomes lower, a larger amount of NPB will be necessary to give the first ingredient a nonflammable characteristic. From the previous study of the influence of NPB on plastics and rubber, it has been determined that the amount of NPB being added to 100 pts.wt. of propylene glycol-based solvent is to be 70 pts.wt. or less. In FIG. 1, this amount is converted and is indicated as approximately 41% or less. As can be seen from the figure, in order to obtain a nonflammable solvent which also satisfies the above condition, the flash point of the first ingredient needs to be 28° C. or above. That is, in considering the negative influence of NPB on plastics and rubber, the flash point of the first ingredient comprised of propylene glycol-based solvent(s) should not be below 28° C., so as to obtain a nonflammable cleaning solvent.

The test results prove that the cleaning solvent of the present invention should satisfying the following conditions:

(1) the amount of IPB and/or NPB added to 100 pts.wt. of the first ingredient is to be 70 pts.wt. or less; and (2) the flash point of the first ingredient is to be 28° C. or above.

CLEANSING TEST

The following test was conducted to study the cleanability of the cleaning solvent according to one aspect of the present invention.

NPB-PnB mixtures and NPB-DPnB mixtures were used as cleaning solvents for this test. 0.5% of nitroethane, 0.5% of butylene oxide, and 0.05% of 2,6-di-tert-butyl-p-cresol were added to the NPB as stabilizers. A test piece was made by applying press oil (#640, Japan Work Oil) to an SPCC mild-steel plate (50×100×0.3 mm) and leaving for three days at room temperature. The amount of oil applied was 200–300 mg/dm$^2$. One of the thus-obtained test pieces was dipped into each of the cleaning solvents for about two minutes and was dried, whereafter the amount of oil remaining on the test piece was determined.

Table 4 shows the results of the cleanability test conducted in several cleaning solvents, each of which having a differentiated mixing ratio of ingredients, respectively. A cleaning solvent was determined to have a good cleanability (indicated as "GOOD" in the table) if the amount of oil remaining on the dried test piece was not more than 2mg/dm$^2$.

TABLE 4

| | TEST NO. | | | | | | | | | |
|---|---|---|---|---|---|---|---|---|---|---|
| | 1 | 2 | 3 | 4 | 5 | 6 | 7 | 8 | 9 | 10 |
| PnB (pts. wt.) | 100 | 100 | 100 | 100 | 100 | — | — | — | — | — |
| DPnB (pts. wt.) | — | — | — | — | — | 100 | 100 | 100 | 100 | 100 |
| NPB (pts. wt.) | 10 | 20 | 30 | 40 | 50 | 8 | 20 | 30 | 40 | 50 |
| cleanability | G | G | G | G | G | G | G | G | G | G |

G: GOOD
PnB: propylene glycol n-butyl ether
DPnB: dipropylene glycol n-butyl ether
NPB: n-propyl bromide From TABLE 4, it can be appreciated that a superior cleansing characteristic comparable to conventional products can be obtained, even when NPB is mixed to the cleaning solvents.

TEST IN METALLIC CORROSION

The following test was conducted to study the metal-corrosiveness of the cleaning solvent according to one aspect of the present invention.

NPB-PnB mixtures and NPB-DPnB mixtures were used as cleaning solvents for this test. 0.5% of nitroethane, 0.5% of butylene oxide, and 0.05% of 2,6-di-tert-butyl-p-cresol were added to NPB as stabilizers. According to a test standardized by JIS-K 1600, an aluminum piece (JIS-H-4000, A1100P) was placed in both the liquid-phase and the gaseous-phase of each cleaning solvent having already been used for cleaning. After leaving the aluminum piece in this condition for 48 hours, the state of corrosion of the metal was studied. The test results are as shown in Table 5.

TABLE 5

| | TEST NO. | | | | | | | | | |
|---|---|---|---|---|---|---|---|---|---|---|
| | 1 | 2 | 3 | 4 | 5 | 6 | 7 | 8 | 9 | 10 |
| PnB (pts. wt.) | 100 | 100 | 100 | 100 | 100 | — | — | — | — | — |
| DPnB (pts. wt.) | — | — | — | — | — | 100 | 100 | 100 | 100 | 100 |
| NPB (pts. wt.) | 10 | 20 | 30 | 40 | 50 | 10 | 20 | 30 | 40 | 50 |
| Corrosion | N | N | N | N | N | N | N | N | N | N |

N: NO CORROSION
PnB: propylene glycol n-butyl ether
DPnB: dipropylene glycol n-butyl ether
NPB: n-propyl bromide From TABLE 5, it has been proven that even when NPB is mixed to the cleaning solvent, hardly any corrosion occurred and that the cleaning solvent has a corrosion-free characteristic comparable to conventional products.

What is claimed is:

1. A glyco-based cleaning solvent comprising:

a first ingredient comprised of one type of propylene glycol-based solvent or a plurality of types thereof, and having a flash point of 28° C. or above, and a second ingredient comprising isopropyl bromide and/or n-propyl bromide;

wherein the glycol-based cleaning solvent is given a nonflammable characteristic by mixing 10–70 parts by weight (pts.wt.) of said second ingredient to 100 pts.wt. of said first ingredient.

2. A glycol-based cleaning solvent according to claim 1, wherein said first ingredient contains at least one propylene glycol-based solvent selected from the group consisting of: propylene glycol methyl ether, dipropylene glycol methyl ether, tripropylene glycol methyl, propylene glycol n-butyl ether, dipropylene glycol n-butyl ether, tripropylene glycol n-butyl ether, propylene glycol methyl ether acetate, propylene glycol diacetate, propylene glycol phenyl ether, and propylene glycol monoethyl ether acetate.

3. A glycol-based cleaning solvent according to claim 1, wherein an organic solvent having a boiling point ranging between 60° C.–150° C. is mixed as an agent for accelerating the dryability of the glycol-based cleaning solvent.

4. A glycol-based cleaning solvent according to claim 2, wherein an organic solvent having a boiling point ranging between 60° C.–150° C. is mixed as an agent for accelerating the dryability of the glycol-based cleaning solvent.

5. A glycol-based cleaning solvent comprising:

a first ingredient comprised of one type of propylene glycol-based solvent or a plurality of types thereof, and having a flash point of 28° C. or above, and a second ingredient comprising isopropyl bromide and/or n-propyl bromide;

wherein 10–70 parts by weight (pts.wt.) of said second ingredient is mixed to 100 pts.wt. of said first ingredient.

6. A glycol-based cleaning solvent according to claim 5, wherein said first ingredient contains at least one propylene glycol-based solvent selected from the group consisting of: propylene glycol methyl ether, dipropylene glycol methyl ether, tripropylene glycol methyl, propylene glycol n-butyl ether, dipropylene glycol n-butyl ether, tripropylene glycol n-butyl ether, propylene glycol methyl ether acetate, propylene glycol diacetate, propylene glycol phenyl ether, and propylene glycol monoethyl ether acetate.

7. A glycol-based cleaning solvent according to claim 5, wherein an organic solvent having a boiling point ranging between 60° C.–150° C. is mixed as an agent for accelerating the dryability of the glycol-based cleaning solvent.

8. A glycol-based cleaning solvent according to claim 6, wherein an organic solvent having a boiling point ranging between 60° C.–150° C. is mixed as an agent for accelerating the dryability of the glycol-based cleaning solvent.

* * * * *